US006565454B2

(12) United States Patent
Halko

(10) Patent No.: US 6,565,454 B2
(45) **Date of Patent: *May 20, 2003**

(54) VARIABLE STRESS WOUND GOLF BALLS AND A METHOD FOR FORMING SUCH GOLF BALLS

(75) Inventor: Roman D. Halko, Chula Vista, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/951,794

(22) Filed: Sep. 13, 2001

(65) Prior Publication Data

US 2002/0022536 A1 Feb. 21, 2002

Related U.S. Application Data

(63) Continuation-in-part of application No. 09/662,883, filed on Sep. 15, 2000, now Pat. No. 6,290,610, and a continuation-in-part of application No. 09/923,390, filed on Aug. 8, 2001, which is a continuation-in-part of application No. 09/497,503, filed on Feb. 4, 2000, which is a continuation-in-part of application No. 09/266,847, filed on Mar. 12, 1999, now Pat. No. 6,149,535.

(51) Int. Cl.[7] ..... A63B 37/06; A63B 37/00
(52) U.S. Cl. ..... 473/362; 473/357; 473/351
(58) Field of Search ..... 473/351–377

(56) References Cited

U.S. PATENT DOCUMENTS 2,425,909 A 8/1947 Wilhelm
4,783,078 A 11/1988 Brown et al.
5,685,785 A 11/1997 Kakiuchi et al.
5,697,574 A 12/1997 Miyakoshi et al.
6,030,296 A * 2/2000 Morgan et al. ..... 473/361
6,113,505 A * 9/2000 Boehm ..... 473/357
6,290,610 B1 * 9/2001 Reid et al. ..... 473/357

OTHER PUBLICATIONS

Farrally, M.R. et al., Science and Golf III: Proceedings of the World Scientific Congress of Golf. Illinios: Human Kinetics, copyright 1999, p. 413.*

* cited by examiner

*Primary Examiner*—Paul T. Sewell
*Assistant Examiner*—Alvin A. Hunter

(57) ABSTRACT

The present invention is directed to an improved golf ball and a method of winding that includes measuring and controlling thread stress directly, rather than maintaining and controlling the level of tension on the threads. The golf ball includes a center, a wound layer that surrounds the center to form a wound core, and a cover that surrounds the wound core. The wound layer is formed of at least one thread, and the wound layer includes a plurality of radially extending sections, each section has a thread stress. The stress within each section is substantially constant, but at least two radially extending sections have different stresses. The method for winding thread onto a golf ball center to form a wound core comprises the steps of measuring a stress within a portion of the thread; winding the thread about the golf ball center while applying a force on the thread to form a plurality of portions with predetermined thicknesses and varying the stress between the portions.

12 Claims, 4 Drawing Sheets

VARIABLE STRESS WOUND GOLF BALLS AND A METHOD FOR FORMING SUCH GOLF BALLS

CROSS-REFERENCE TO RELATED APPLICATIONS

This application is a continuation-in-part of application Ser. No. 09/662,883, filed Sep. 15, 2000 now U.S. Pat. No. 6,290,610, and a continuation-in-part of application Ser. No. 09/923,390 filed Aug. 8, 2001, which is a continuation-in-part of application Ser. No. 09/497,503 filed Feb. 4, 2000, which is a continuation-in-part of application Ser. No. 09/266,847, filed Mar. 12, 1999, now U.S. Pat. No. 6,149,535, the contents of which are incorporated herein by express reference thereto.

FIELD OF THE INVENTION

This invention relates generally to golf balls, and more particularly to wound golf balls that have radially-extending sections of thread windings with variable stress, and a method for forming such golf balls.

BACKGROUND OF THE INVENTION

Wound golf balls are the preferred ball of more advanced players due to their spin and feel characteristics. Wound balls typically have either a solid rubber or fluid-filled center around which a wound layer is formed, which results in a wound core. The wound layer is formed of thread that is stretched and wrapped about the center. The wound core is then covered with a durable-cover material, such as a SURLYN® or similar material, or a softer "performance" cover, such as Balata or polyurethane.

Wound balls are generally softer and provide more spin than solid balls. This enables a skilled golfer to have more control over the ball's flight and final position. Particularly, with approach shots into the green, the high spin rate of soft-covered-wound balls enables the golfer to stop the ball very near its landing position. In addition, wound balls exhibit lower compression than two-piece balls. Their higher spin rate means wound balls generally display shorter distance than hard-covered-solid balls. The advantages of wound constructions over solid ones, however, relate more to targeting or accuracy than distance.

To meet the needs of golfers with various levels of skill, golf ball manufacturers also vary the compression of the ball, which is a measurement of the deformation of a golf ball under a fixed load. A ball with a higher compression feels harder than a lower-compression. Wound golf balls generally have a lower compression than solid balls, which is preferred by better players. Whether wound or solid, all golf balls become more resilient (i.e., have higher initial velocities) as compression increases. Players generally seek a golf ball that delivers maximum distance, which requires a high initial velocity upon impact; therefore, manufacturers of both wound and solid golf balls balance the requirement of higher initial velocity from higher compression with the desire for a softer feel from lower compression.

To make wound golf balls, manufacturers use automated winding machines to stretch the threads to various degrees of elongation during the winding process without subjecting the threads to unnecessary incidents of breakage. As the elongation and the winding tension increases, the compression and initial velocity of the ball increases. Thus, a more-lively wound ball is produced, which is desirable.

Some methods attempt to employ constant tension during the entire winding process by attempting to apply a constant pull or force on the thread. However, variations in thread cross-sectional area prevent balls formed under constant pull from having constant stress or constant elongation throughout the ball. For example, as the cross-sectional area of the thread decreases, the thread stretches to a greater degree given a constant pull. Conversely, as the cross-sectional area of the thread increases, the thread stretches to a lesser degree under a constant pull. This results in uncontrolled variations in stress and in compression throughout the finished ball, which may negatively affect the ball's performance.

Furthermore, to account for variations in thread cross-sectional area, manufacturers of wound balls do not wind using the maximum tension or stretch the thread to the maximum elongation, because to do so would cause an excessive amount of thread breakage during manufacture or play. This also prevents manufacturers from optimizing ball performance. In addition, the rubber elastic modulus also affects compression which is not considered when manufacturers attempt to control tension alone.

U.S. Pat. No. 4,783,078 to Brown et al. discloses one method used in an effort to decrease thread breakage. In this patent, thread is wound first at low tension then at high tension. Controlling tension alone, however, is an approximate means of achieving the desired compression.

U.S. Pat. No. 2,425,909 to Wilheim discloses one winding method that considers the cross-sectional area of the thread during winding. In this patent, an apparatus measures the pounds per square inch tension of a portion of thread during winding, applies the level of total tension to the thread during winding, and automatically adjusts the level according to the pounds per square inch tension measurement in order to keep the pounds per square inch tension value constant throughout the winding process.

Golf ball manufacturers are continually searching for new ways in which to provide wound golf balls that deliver improved performance for golfers while decreasing the occurrence of thread breaks both during manufacturing and during play. It would be advantageous to provide a wound golf ball with a higher compression, higher initial velocity, improved durability, and improved manufacturing processibility. The present invention provides such a wound golf ball.

SUMMARY OF THE INVENTION

The present invention is directed to an improved golf ball and a method of winding a golf ball that includes measuring and controlling thread stress directly, rather than maintaining and controlling the level of tension on the threads.

The golf ball includes a center, a wound layer that surrounds the center to form a wound core, and a cover that surrounds the wound core. The wound layer is formed of at least one thread, and the wound layer includes a plurality of radially-extending sections. Each section has a thread stress. The stress within each section is substantially constant, but at least two radially-extending sections have different stresses. The thickness of a radially extending section can be as small as about 0.007 inches. According to one aspect of the present invention, substantially constant means the percentage stress variation within a section is less than the percentage thread cross-sectional area variation within the same section.

In one embodiment, the stresses are different by at least 10%. In another embodiment, the stress increases from one radially extending section to another in a radially-outward direction. In another embodiment, the stress decreases from one radially-extending section to another in a radially-outward direction. The stress can also alternate between sections.

In one embodiment, the golf ball further includes first and second stresses. The first stress is less than about 40% of the breaking stress of the thread and the second second stress is greater than about 40% of the breaking stress.

In yet another embodiment, the golf ball can include first- and second-wound layers, and a molded-intermediate layer. The first-wound layer surrounds the center. The molded-intermediate layer surrounds the first-wound layer, and the second-wound layer surrounds the first-wound layer. The first- and second-wound layers include a plurality of radially-extending sections, each section has a stress, wherein at least two sections within each layer have different stresses and the stress within each first section is substantially constant.

According to one aspect of the present invention, the stress varies constantly or in intervals.

The method for winding thread onto a golf ball center to form a wound core comprises the steps of measuring stress within a portion of the thread; winding the thread about the golf ball center while applying a force thereon to form a first portion with a predetermined thickness and the first portion having thread with stress equal to a first value; and winding the thread about the golf ball center under the force to form a second portion with a predetermined thickness and the second portion having thread with stress that is different from the first value.

In one embodiment, winding the thread about the golf ball center to form the second portion further includes forming a plurality of subsections within the second portion of predetermined thickness. The stress in the subsections varies from the first value and varies from the stress value in adjacent subsections.

In another embodiment, the stress varies during winding constantly or in intervals.

According to one aspect of the present invention, the step of measuring the stress is continuous during winding and further includes passing the thread over at least two-spaced rollers; vibrating the portion of the thread between the rollers; measuring the vibration of the portion of the thread; and calculating stress from the vibration measurement. The step of vibrating the portion of the thread between the rollers further includes directing air upon the portion of the thread.

According to yet another aspect of the present invention, the step of applying the force further includes passing the thread over a tension wheel that rotates about a shaft, and applying a braking force on the shaft. For example, a magnetic brake or a friction brake applies the braking force.

DETAILED DESCRIPTION OF THE PREFERRED EMBODIMENTS

The present invention is directed to an improved golf ball, and an apparatus and a method for winding such a golf ball. The ball generally comprises a core and a thread wound layer. Preferably, the ball also includes a cover. The apparatus generally includes a winding station, a thread supply and at least one braking region for applying a force on the thread during winding. The method generally includes winding thread on a center with controlled but variable stress. The present invention can be utilized with various configurations of cores, double covers, and winding apparatuses, and thus the present invention is not limited to any particular types of ball and winding apparatus shown and discussed below.

Figure 1:
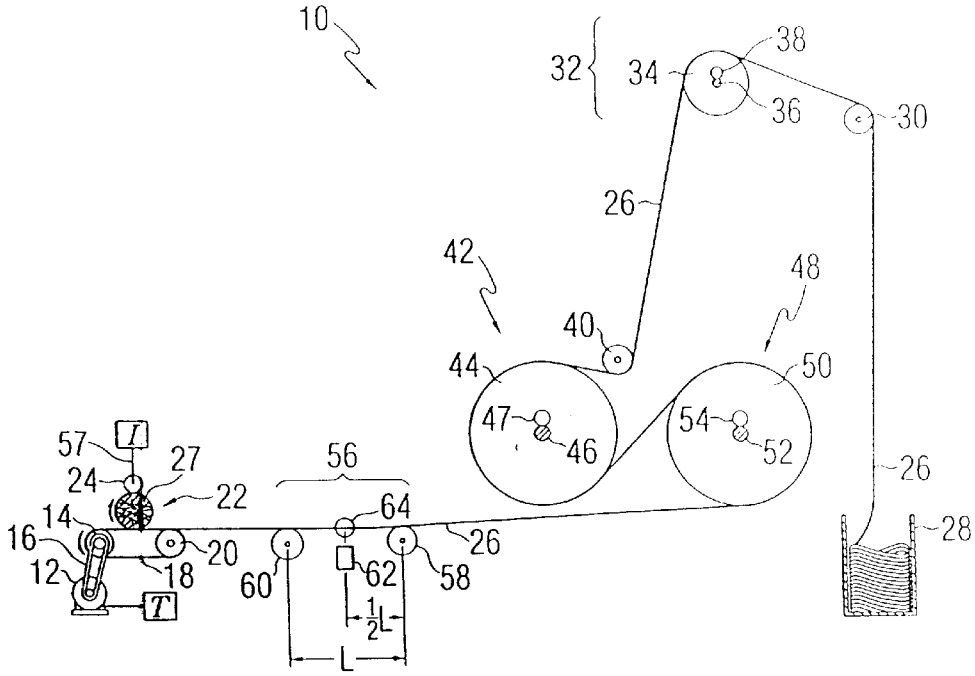
FIG. 1 is a schematic, side view of a golf ball winding apparatus of the present invention, wherein portions are removed for clarity.

FIG. 1 shows a golf ball winding apparatus 10 according to the present invention. The apparatus 10 includes a motor 12 that drives a first wheel 14 via a belt 16. A rubber belt 18 for supporting a golf ball core 22 surrounds the first wheel 14 and a second wheel 20. A third wheel 24 rests upon the golf ball core 22 and measures the diameter of the core and secures the core against the belt 18. The belt 18 rotates, and rotates the golf ball core 22, which draws thread 26 attached to a center 27 through the apparatus from a supply box 28 to form the core 22.

From the supply box 28, the thread 26 first passes over a first idler roller 30 and then to a first braking region 32. The first braking region 32 includes a tension wheel 34 rotatably supported on a shaft 36. A first brake 38 is operatively associated with or directly attached to the shaft 36 to apply a braking force thereto.

From the first braking region 32, the thread 26 travels around a second idler roller 40 to a second braking region 42 that includes tension wheel 44 that is rotatably supported on a shaft 46. The second braking region 42 further includes a second brake 47 operatively associated with or directly attached to the shaft 46.

After passing through the second braking region 42, the thread passes to a third braking region 48 that includes tension wheel 50, which is rotatably supported on a shaft 52. A third brake 54 is operatively associated with or directly attached to the shaft 52.

The brakes 38, 47, and 54 are preferably magnetic brakes. One recommended magnetic brake is commercially available from Magtrol, Inc. of Buffalo, N.Y. under the name hysterisis brake. This magnetic brake creates a braking torque that is constant and will respond to increases or decreases in coil current or voltage with corresponding increases or decreases in torque (i.e., an electromagnetic brake). Alternatively, friction brakes, permanent magnet brakes such as magnetic particle brakes, or any other suitable torsional drag producing devices for applying drag forces to a rotating shaft can be used. It is understood that the present invention may work by having and/or using any one or all of the aforementioned brakes 38, 47, and 54. In addition, it may suffice to control only the last of the three braking regions 48. Controlling all three braking regions 32, 42 and 48 makes the system more versatile.

Downstream from the third braking region 48 is a thread vibration region 56 comprising two rotatably mounted, low-drag rollers 58 and 60. The rollers 58 and 60 are spaced apart at a fixed distance L. It is preferred that the distance L is between about one inch and about two feet, and more preferably between about five inches and about twelve inches. The rollers 58 and 60 are located just before the thread reaches the belt 18 that supports the wound core 22.

Figure 2:
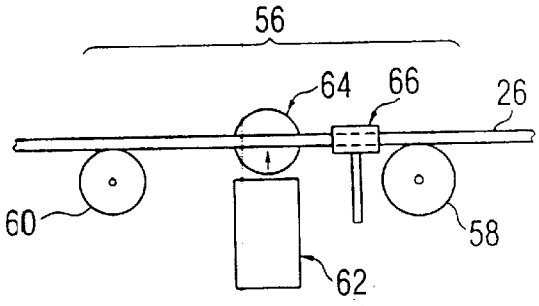
FIG. 2 is an enlarged, side view of a thread vibration region of the apparatus of FIG. 1.
Figure 3:
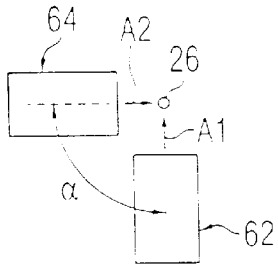
FIG. 3 is an enlarged, front view of a thread and a pair of air jets disposed there about.

Referring to FIGS. 1–3, preferably two air jets 62 and 64 are located within the thread vibration region 56. The air jets 62 and 64 are recommended to be located at the midpoint of length L. The first air jet 62 is below the thread 26, and the second air jet 64 is transverse of the thread 26 so that the angle ' between the jets is about 90°. The air jets 62 and 64 are also perpendicular to the thread 26. The air jets 62 and 64 direct air, which is labeled A1 and A2, respectively, upon the portion of the thread 26 between the rollers 58 and 60. The air A1 and A2 vibrates the thread 26 portion between the rollers 58 and 60. In another embodiment, the apparatus uses only one air jet.

Referring to FIG. 1, after passing through the thread vibration region 56, the thread 26 continues to the golf ball core 22. Golf ball center 27 is shown with some thread windings thereabout. As the size of the golf ball core 22 increases after adding more thread, wheel 24 rises and rod 57 attached thereto also rises. Rod 57 can suitably be the core of a transducer that serves as an indicator I of the then diameter of the golf ball core 22.

Alternatively or additionally to the indicator I, a timer T can be used. The timer T is connected to the motor 12, and when the motor starts the timer starts monitoring so that the time after the thread begins winding about the golf ball core 22 is known.

Referring again to FIGS. 1 and 2, the apparatus 10 further includes a frequency measuring device 66 attached to a frame (not shown) that also supports rollers 58 and 60. The device 66, alternatively, attaches to the roller 60. There is a space between the device 66 and the thread 26. One recommended frequency measuring device 66 is a laser sensor, which is commercially available under the name PicoDot™ Laser Convergent Sensor and made by Banner Engineering Corp. of Minneapolis, Minn. Other recommended frequency measuring devices include photoelectric sensors, acoustic transducers, or vibration sensors.

Figure 4:
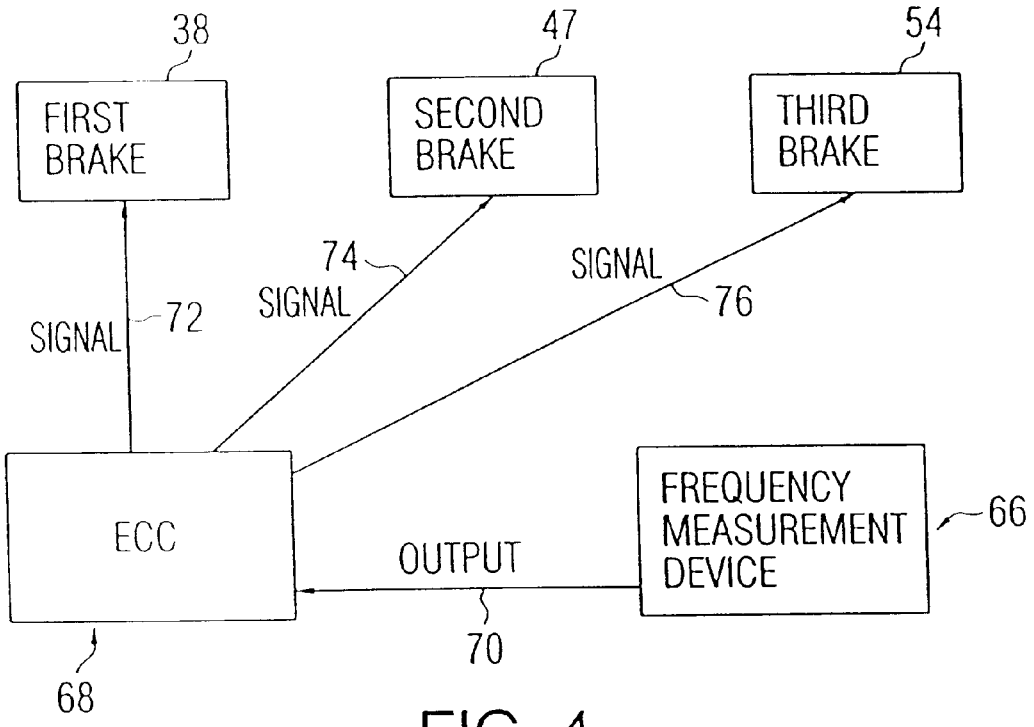
FIG. 4 is a schematic representation of the relationship between electronic control circuitry and the apparatus of FIG. 1.

Referring to FIG. 4, electronic control circuitry ("ECC") 68, the frequency measuring device 66, and the brakes 38, 47, and 54 are electrically connected. The electronic control circuitry 68 preferably comprises various sensors and actuators associated with a programmable logic controller that is used with software to achieve the functions discussed below. The ECC measures the frequency transducer output 70 from the frequency measuring device 66, converts this frequency to the stress of the portion of the thread, and produces voltage or current signals 72, 74 and/or 76 related to the desired frequency output. If the measured frequency value or stress does not match the desired frequency or stress, then the control circuitry 68 changes the current to one or all of the brakes 38, 47, and/or 54 within the braking regions 32, 42, and/or 48 (as shown in FIG. 1) to increase or decrease the drag on the thread, as required, so that the desired frequency is met.

One of the steps in calculating stress from the frequency is for one of the ECC sensors to convert the oscillation of the thread into a pulse train that may be counted by the ECC. The control method to precisely control the stress of the thread material being wound onto the center accumulates the frequency count and then applies a Proportional, Integral, and Derivative (PID) control function or algorithm. The PID algorithm is known in the art. The operator selects constants P, I, and D in the algorithm to adjust the stress to the desired stress rapidly and to correct errors. The operator selects the values for P, I, and D to provide the desired response depending on the systems mechanical configuration and control response capabilities. This control exhibited by output responses or signals 72, 74 and/or 76 generated by the ECC are communicated to the brakes as follows:

command output=((error_now**P*_gain)+((error_now−last_error)**D*_gain)+(cumulative_error**I*_gain);

where error_now is the difference between the actual vibration frequency (or stress) of the thread and the desired vibration frequency of the thread;

cumulative_error is the accumulated amount of uncorrected error over time or (cumulative_error+error_now);

last_error is the error taken for use in the next sample or error_now; and

P_gain, D_gain and I_gain are known by those of ordinary skill in the art. In addition, other methods can be used instead of a PID algorithm as also known by those of ordinary skill in the art.

The error term is based on the desired stress defined by a pre-loaded (or on-the-fly) adjustment from the control system or external source (i.e., a predetermined or desired stress). The PID loop is a closed loop controller that acts to compensate for the error between the desired stress and the actual stress or frequency. The update time required is empirically determined and may correspond to frequencies between 200 and 500 Hz. In general, the update time is the period corresponding to the frequency.

Now, the relationship between natural frequency and stress will be discussed. The vibrating thread allows measurement of the stress in the thread by sensing the natural frequency of vibration of the thread as indicated by the following formula:

$$f_n = \frac{1}{2L} * \left[\frac{T}{\rho}\right]^{1/2},$$

where $f_n$=natural frequency of thread vibration;

L=distance between the rollers;

T=thread tension, which is variable; and

ρ=density per unit length, which is variable.

Since most quality wound balls use rubber thread of fairly uniform density, and the length (L) is held constant by fixing the distance between the two rollers, the above equation reduces to the following relationship:

$f_n$ is directly proportional to $$\left[\frac{T}{A}\right]^{1/2} = \sigma^{1/2},$$

where

σ=thread stress in psi or equivalent units; and

A=cross-sectional area, which is variable.

Thus, a measure of the natural frequency of the vibrating thread gives a good approximation of stress on the thread. An accurate measure of the natural frequency of thread vibration can be accomplished as discussed below.

With reference to FIGS. 1–4, the operation of the apparatus 10 will now be discussed. The method for winding thread 26 onto the golf ball center 27 to form wound core 22 comprises the steps of measuring a stress within a predetermined portion of the thread 26 located in the thread vibration region 56. This measuring is accomplished by passing the thread 26 over at least two, spaced rollers 58 and 60, then vibrating the portion of the thread between the rollers 58 and 60 by directing air A1 and A2 from airjets 62 and 64 upon the thread 26.

Then, the frequency measurement device 66 measures the vibration frequency of the thread portion and sends an output signal 70 to the ECC 68. The ECC converts the vibration measurement or frequency into the stress, as discussed above. Winding the thread about the golf ball center 22 occurs while applying a force to the thread using the brakes 38, 47, and/or 54 so that the stress in the portion of the thread is at a first, predetermined value. After a predetermined time according to timer T and/or a predetermined diameter value according to the indicator I, winding the thread about the golf ball center under an applied force occurs so that the stress in the portion of the thread is different from the first value. The stress changes so that it equals a desired stress value according to a stress pattern, as discussed below. The ECC outputs a signal 70 to one or more of the brakes 38, 47 and/or 54 to apply a braking force to the associated shaft 36, 46, and/or 52 to change the force on the thread and thus the stress on the thread. A plurality of predetermined, desired stress values can be used and the winding can be controlled to meet these desired stress values at certain times or diameter values.

EXAMPLES

These and other aspects of the present invention may be more fully understood with reference to the following non-limiting examples, which are merely illustrative of preferred embodiments of the present invention golf ball core, and are not to be construed as limiting the invention, the scope of which is defined by the appended claims.

Table I sets forth the stress winding pattern used for three examples of inventive balls. In the examples, the stress value is represented by a letter from A to D and the stress value increases with each letter.

TABLE I

EXAMPLES OF INVENTIVE BALLS

| Percentage of Total Wound Layer Thickness (%) | Example 1 Stress Pattern | Example 2 Stress Pattern | Example 3 Stress Pattern |
|---|---|---|---|
| 25 | A | D | D |
| 50 | A | C | B |
| 75 | B | B | B |
| 100 | B | A | D |

Figure 5:
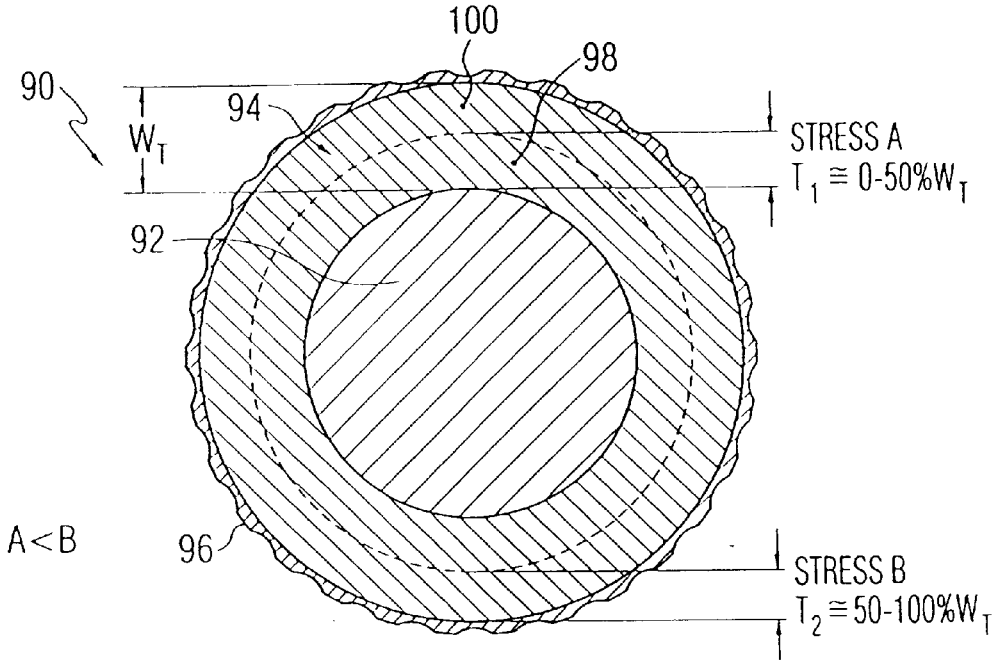
FIGS. 5–8 are cross-sectional views of various golf balls of the present invention.

A golf ball 90 of Example 1 is shown in FIG. 5. The golf ball 90 includes a solid center 92 surrounded by a wound layer 94 to form a wound core. A cover 96 surrounds the wound core adjacent the wound layer 94. The wound layer 94 includes a plurality of radially extending sections 98 and 100. The first section 98 extends from the center 92 to about 50% of the total wound layer thickness $W_T$ as measured by the indicator I (shown in FIG. 1) so that the thickness of the first section is $T_1$. The thread forming the first section 98 has a stress A. The second section 100 extends from the first section 98 and about 50% to 100% of the total wound layer thickness $W_T$ so that the thickness of the second section is $T_2$. The thread forming the second section 98 has a stress B, which is greater than stress A. Thus, the ball 90 is formed by varying the stress during winding from low stress A to high stress B in a radially outward direction.

In one recommended embodiment, using polyisoprene thread and a distance L of about 11 inches, the stress A can have a value corresponding to a frequency of between about 190 Hz and about 390 Hz, more preferably of about 290 Hz. The stress B can have a value corresponding to a frequency of between about 510 Hz and about 710 Hz, and more preferably of about 610 Hz. As the difference between the stress in the center most section and the adjacent section increases, the compression and initial velocity increase. In addition, the spin off various clubs, such as a driver, ½ wedge and 8 iron for a ball with sections of varying stress will increase from the driver to the 8-iron.

In another embodiment, the center 92 can be fluid-filled and/or the stress pattern can decrease in a radially-outward direction. A ball wound from low stress to high stress in a radially outward direction tends to have lower spin than a ball wound from high stress to low stress in a radially outward direction.

Figure 6:
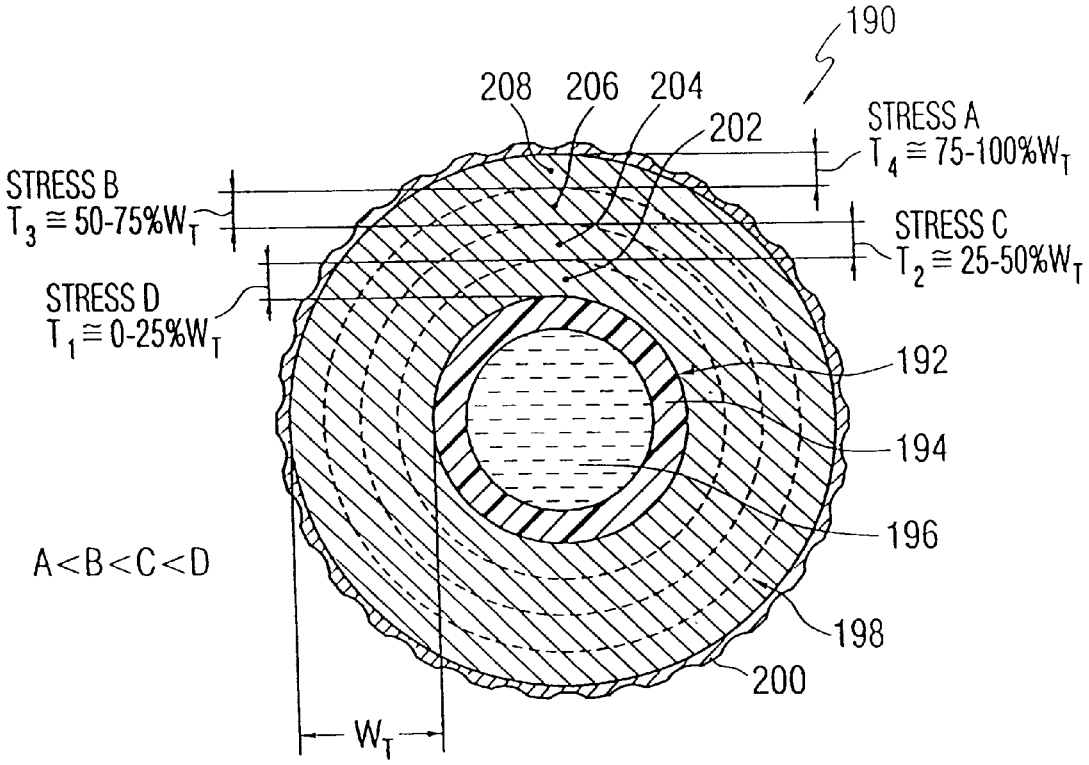

A golf ball 190 of Example 2 is shown in FIG. 6. The golf ball 190 includes a fluid-filled center 192 that includes an envelope 194 filled with a fluid 196. The center 192 is surrounded by a wound layer 198 to form a wound core. A cover 200 surrounds the wound core adjacent the wound layer 198. The wound layer 198 includes four radially extending sections 202, 204, 206, and 208.

The first section 202 extends from the center 192 to about 25% of the wound layer thickness $W_T$ so that the thickness of the first section is $T_1$. The thread forming the first section 202 has a stress D. The second section 204 extends from about 25% to about 50% of the total wound layer thickness $W_T$ so that the thickness of the second section is $T_2$. The thread forming the second section 204 has a stress C, which is less than stress D. The third section 206 extends from about 50% to about 75% of the wound layer thickness $W_T$ so that the thickness of the third section is $T_3$. The thread forming the third section 208 has a stress B, which is less than stress C. The fourth section 208 extends from about 75% to about 100% of the total wound layer thickness $W_T$ so that the thickness of the fourth section is $T_4$. The thread forming the fourth section 208 has a stress A, which is less than stress B. Thus, the ball 190 is formed by varying the stress during winding from high stress D to low stress A in a radially-outward direction.

In one recommended embodiment, using polyisoprene thread and a distance L of about 11 inches, the stress D can have a value corresponding to a frequency of between about 735 Hz and about 935 Hz, and more preferably of about 835 Hz. The stress C can have a value corresponding to a frequency of between about 620 Hz and about 820 Hz, and more preferably of about 720 Hz. The stress B can have a value corresponding to a frequency of between about 510 Hz and about 710 Hz, and more preferably of about 610 Hz. The stress A can have a value corresponding to a frequency of between about 190 Hz and about 390 Hz, and more preferably of about 290 Hz. In another embodiment, the center can be solid and/or the stress pattern can increase in a radially outward direction.

Figure 7:
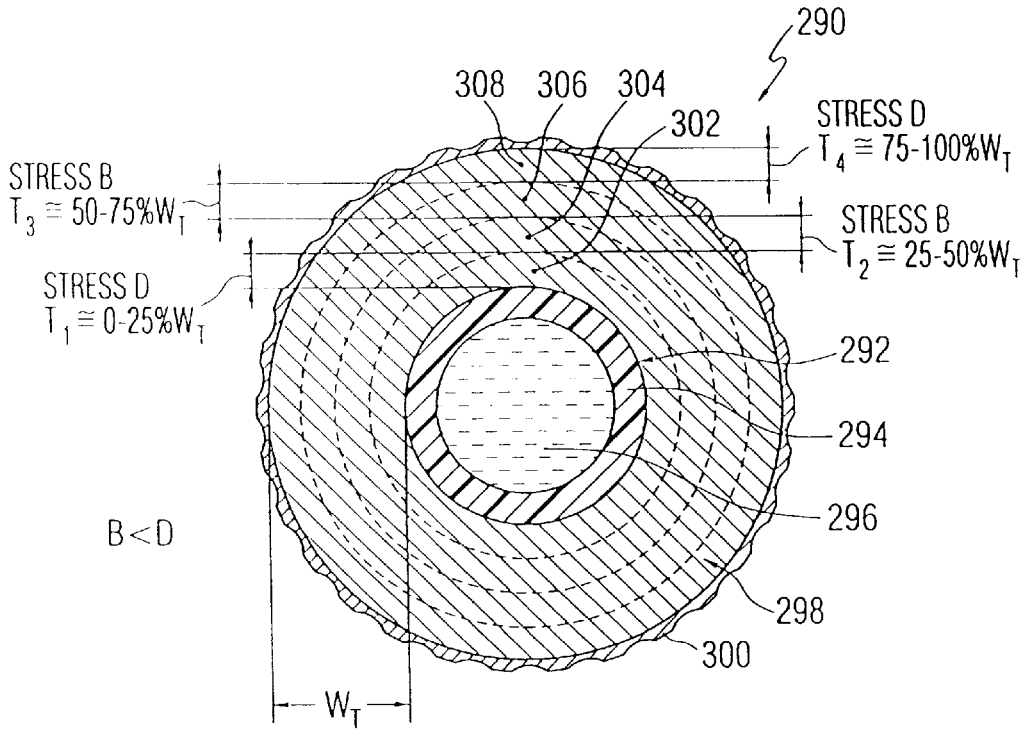

A golf ball 290 of Example 3 is shown in FIG. 7. The golf ball 290 includes a fluid-filled center 292 that includes an envelope 294 filled with a fluid 296. The center 292 is surrounded by a wound layer 298 to form a wound core. A cover 300 surrounds the wound core adjacent the wound layer 298. The wound layer 298 includes four radially extending sections 302, 304, 306, and 308.

The first section 302 extends from the center 392 to about 25% of the wound layer thickness $W_T$ so that the thickness of the first section is $T_1$. The thread forming the first section 302 has a stress D. The second section 304 extends from about 25% to about 50% of the wound layer thickness $W_T$ so that the thickness of the second section is $T_2$. The thread forming the second section 304 has a stress B, which is less than stress D. The third section 306 extends from about 50% to about 75% of the wound layer thickness $W_T$ so that the thickness of the third section is $T_3$. The thread forming the third section has stress B. The fourth section 308 extends from about 75% to about 100% of the wound layer thickness $W_T$ so that the thickness of the fourth section is $T_4$. The thread forming the fourth section 308 has stress D. The ball 290 is formed by varying the stress between at least two adjacent sections during winding. In another embodiment, the center can be solid.

In the above examples, winding the thread about the golf ball center occurs while applying force to form a plurality of radially extending sections or portions wound to a predetermined thickness. Each section may have a different stress as discussed above. The above frequency values are for a natural rubber thread with an unstretched cross-section of 0.063 inch by 0.020 inch and the length L (as shown in FIG. 1) between rollers is about 11 inches.

In the embodiments above, the stress can be varied constantly during winding so that the stress within each radial section is changing with diameter or the stress can be varied in a step-wise fashion or in intervals so that the stress within each radial section is substantially constant. In the above embodiments, instead of using diameter and the indicator I (as shown in FIG. 1) to control the intervals when the stress changes, time and the timer T can be used.

The stress within each section is substantially constant, but at least two radially extending sections have different stresses. Substantially constant stress within a section means that the percentage stress variation within the section is less than the percentage thread cross-sectional area variation within the same section. For example, if the cross-sectional area variations of the thread within a section are about 14%, the ball should be wound with the stress within the section substantially constant or varying by about 5%. Since the 5% variation in stress in the section is less than the 14% variation in thread cross-sectional area in the section, the stress within the section is substantially constant, and therefore according to the aspects of the present invention.

The thickness of a radially extending section can be as small as about 0.007 inches or about 0.008 inches. This is the thickness of a strand of about 0.020 inch and about 0.024 inch thread after elongation. The stress between sections should have a difference of at least about 10%, and more preferably of at least about 25%.

In the above examples, winding may occur at a force or tension of about 1.63 lbs for a winding time of 40 seconds. The thread length before winding is approximately 90 feet. The thread length after winding is approximately 810 feet. The thread is wound at a rate of about 20 feet per second.

The preferred stresses within each section can be expressed as a percentage of the breaking stress. In an inventive golf ball with two adjacent varying stress sections, preferably the first stress in the first section is below about 40% of the breaking stress and the second stress within the second section is over about 40% of the breaking stress. The following non-limiting examples in Tables II and III show inventive balls according to this aspect of the invention.

TABLE II

EXAMPLE OF AN INVENTIVE BALL WITH STRESS ACCORDING TO BREAKING TENSION

| Percentage of Total Wound Layer Thickness (%) | Stress or % of Breaking Stress | Frequency (Hz) |
|---|---|---|
| 12 | 30.8 | 281.6 |
| 88 | 62.5 | 570.8 |

In the inventive golf ball of Table I with two adjacent varying stress sections, preferably the first stress in the first section is between about 20% and about 40% of the breaking stress. The second stress in the second section is between about 50% and 75% of the breaking stress. In the example of Table II, the first stress is about 30.8% of the breaking stress and the first section has a thickness of about 12% of the total wound layer thickness. The second stress is about 62.5% of the breaking stress and the second section has a thickness of about 88% of the total wound layer thickness. The frequency for each associated stress is also shown in Table II.

TABLE III

EXAMPLE OF AN INVENTIVE BALL WITH STRESS ACCORDING TO BREAKING TENSION

| Percentage of Total Wound Layer Thickness (%) | Stress or % of Breaking Stress | Frequency (Hz) |
|---|---|---|
| 10 | 31.7 | 289.2 |
| 90 | 91.7 | 837.2 |

In the inventive golf ball of Table II with two adjacent varying stress sections, preferably the first stress is below 40% of the breaking stress. The second stress in the second section is above 40% of the breaking stress. In the example of Table III, the first stress is about 31.7% of the breaking stress and the first section has a thickness of about 10% of the total wound layer thickness. The second stress is about 91.7% of the breaking stress and the second section has a thickness of about 90% of the total wound layer thickness. The frequency for each associated stress is also shown in Table III.

In another embodiment, wherein the inventive golf ball has four different adjacent stress sections, the first stress is between about 10% and about 30% of the breaking stress, the second stress in the second section is between about 25% and 50% of the breaking stress, the third stress in the third section is between about 45% and about 70% of the breaking stress, and the fourth stress in the fourth section is between about 65% and about 95% of the breaking stress.

Figure 8:
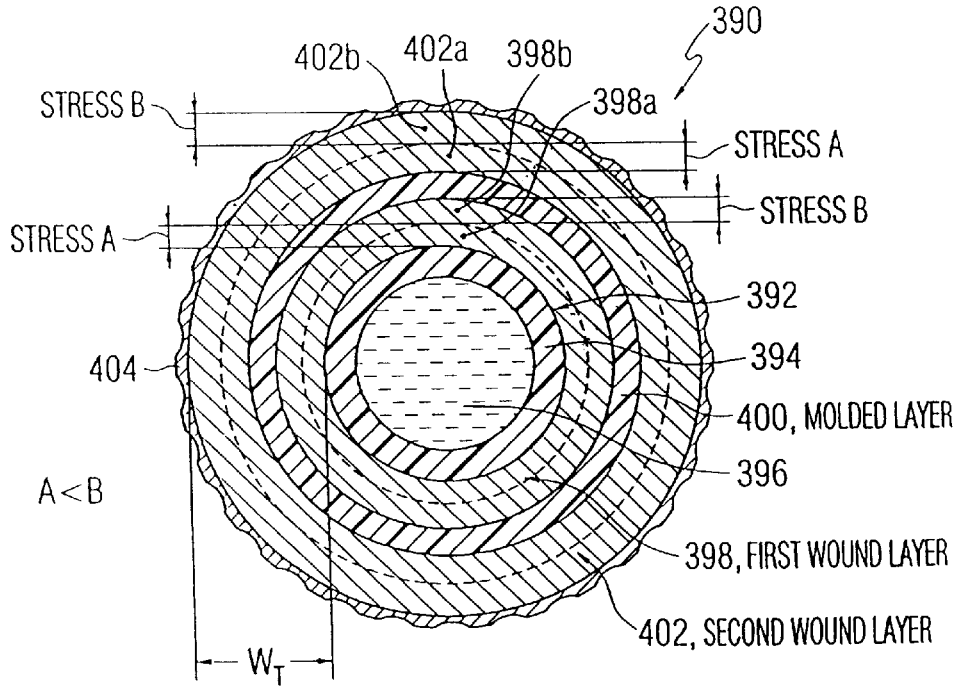

A golf ball 390 is shown in FIG. 8. The golf ball 390 includes a fluid-filled center 392 that includes an envelope 394 filled with a fluid 396. The center 392 is surrounded by a first wound layer 398 to form a wound core. A molded, intermediate layer 400 is disposed over the wound layer 398. A second wound layer 402 surrounds the intermediate layer 400. A cover 404 surrounds the second wound layer 402. The wound layer 398 includes two radially extending sections 398*a* and 398*b* with stresses A and B, respectively. The wound layer 402 includes two radially extending sections 402*a* and 402*b*, with stresses A and B, respectively. Alternatively, the golf ball 390 can be formed with a solid center. The intermediate layer 400 can be formed of either solid core material, cover material, or a different material, as discussed below.

Suitable solid core materials include thermosets, such as rubber, polylbutadiene, polyisoprene; thermoplastics such as ionomer resins, polyamides or polyesters; or a thermoplastic elastomer. Suitable thermoplastic elastomers include Pebax®, Hytrel®, thermoplastic urethane, and Kraton®, which are commercially available from Elf-Atochem, DuPont, various manufacturers, and Shell, respectively. Other suitable core materials can be castable materials, such as urethane, polyurea, epoxy, and silicone. Conventional methods are used to form such cores.

With respect to fluid-filled centers, the envelope for the fluid-filled center is conventional and formed of conventional materials. The envelopes can be filled with a wide variety of materials conventional fluids including gas, water solutions, gels, foams, hot-melts, other fluid materials and combinations thereof. The fluid or liquid in the center can be varied to modify the performance parameters of the ball, such as the moment of inertia, weight, initial spin, and spin decay.

Suitable gases include air, nitrogen and argon. Preferably, the gas is inert. Examples of suitable liquids include either solutions such as salt in water, corn syrup, salt in water and corn syrup, glycol and water or oils. The liquid can further include water soluble or dispersable organic compounds, pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthionic oil. Examples of suitable melts include waxes and hot melts. Hot-melts are materials which at or about normal room temperatures are solid but at elevated temperatures become liquid.

The fluid can also be a reactive liquid system which combines to form a solid or create internal pressure within the envelope. Examples of suitable reactive liquids that form solids are silicate gels, agar gels, peroxide cured polyester resins, two part epoxy resin systems and peroxide cured liquid polybutadiene rubber compositions. Of particular interest are liquids that react to form expanding foams. It is understood by one skilled in the art that other reactive liquid systems can likewise be utilized depending on the physical properties of the envelope and the physical properties desired in the resulting finished golf balls.

Referring to FIGS. 5–8, the covers 100, 200, 300 and 404 can be formed of material, such as ionomer resins, blends of ionomer resins, thermoplastic or thermoset urethane, Balata, metallocene, polyurethane or a combination of the foregoing. The covers can also have two layers where the first layer surrounds the wound core and the second layer surrounds the first cover layer.

Any process that results in accurate and repeatable central placement of the core within the cover is acceptable. Generally, covers are applied by compression molding, injection molding (e.g., liquid injection molding, reinforced reaction injection molding, and structural reaction injection molding), or by casting cover material over the core. One suitable method for applying a cover to a ball is disclosed in the "pinless" centering method of U.S. Pat. No. 5,947,843, which is incorporated in its entirety by reference herein.

The cover of the golf ball can include one or more layers and is generally made of polymeric materials such as ionic copolymers of ethylene and an unsaturated monocarboxylic acid which are available under the trademark SURLYN® of E. I. DuPont de Nemours & Company of Wilmington, Del. or IOTEK® or ESCOR® from Exxon Corp. of Irving, Tex. These are copolymers or terpolymers of ethylene and methacrylic acid or acrylic acid partially neutralized with zinc, sodium, lithium, magnesium, potassium, calcium, manganese, nickel or the like.

In another embodiment, the cover can be formed from mixtures or blends of zinc, lithium and/or sodium ionic copolymers or terpolymers.

Also, SURLYN® resins for use in the cover are ionic copolymers or terpolymers in which sodium, lithium or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The invention can likewise be used in conjunction with covers having inner or outer layers formed from homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes such as those prepared from polyols and diisocyanates or polyisocyanates and those disclosed in U.S. Pat. No. 5,334,673, which is incorporated in its entirety by reference herein.

(4) Polyureas such as those disclosed in U.S. Pat. No. 5,484,870, which is incorporated in its entirety by reference herein.

(5) Polyamides such as poly(hexamethylene adipamide) and others prepared from diamines and dibasic acids, as well as those from amino acids such as poly (caprolactam), and blends of polyamides with Surlyn, polyethylene, ethylene copolymers, ethyl-propylene-non-conjugated diene terpolymer, etc.

(6) Acrylic resins and blends of these resins with poly vinyl chloride, elastomers, etc.

(7) Thermoplastics such as the urethanes, olefinic thermoplastic rubbers such as blends of polyolefins with ethylene-propylene-non-conjugated diene terpolymer, block copolymers of styrene and butadiene, isoprene or ethylene-butylene rubber, or copoly(ether-amide), such as PEBAX® sold by ELF Atochem of France.

(8) Polyphenylene oxide resins, or blends of polyphenylene oxide with high impact polystyrene as sold under the trademark NORYL® by General Electric Company, Pittsfield, Mass.

(9) Thermoplastic polyesters, such as polyethylene terephthalate, polybutylene terephthalate, polyethylene terephthalate/glycol modified and elastomers sold under the trademarks HYTREL® by E. I. DuPont de Nemours & Company of Wilmington, Del. and LOMOD® by General Electric Company, Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. and polyvinyl chloride with acrylonitrile butadiene styrene or ethylene vinyl acetate or other elastomers. Blends of thermoplastic rubbers with polyethylene, propylene, polyacetal, nylon, polyesters, cellulose esters, etc.

Preferably, the cover includes polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly (ethylene terephthalate), poly(butylene terephthalate), poly (ethelyne vinyl alcohol), poly(tetrafluoroethylene) and their copolymers including functional comonomers and blends thereof.

In one embodiment, the cover includes materials such as polyether or polyester thermoplastic urethanes, thermoset urethanes, and ionomers such as acid-containing ethylene copolymer ionomers, including E/X/Y terpolymers where E is ethylene, X is an acrylate or methacrylate-based softening comonomer present in 0 to 50 weight percent and Y is acrylic or methacrylic acid present in 5 to 35 weight percent. More preferably, in a low spin rate embodiment designed for maximum distance, the acrylic or methacrylic acid is present in 15 to 35 weight percent, making the ionomer a high modulus ionomer. In a high spin embodiment, the cover includes an ionomer where an acid is present in 10 to 15 weight percent and includes a softening comonomer.

Castable reactive liquid materials are particularly preferred for the outer cover layers of the balls of the present invention. As used herein, the term "castable reactive liquid material" may refer to thermoset or thermoplastic materials. In a preferred embodiment, the castable reactive liquid material is a thermoset material. As used herein, the term "thermoset" refers to an irreversible, solid polymer that is the product of the reaction of two or more prepolymer precursor materials formed from a castable reactive liquid material.

In another preferred embodiment, the castable reactive liquid material is cast urethane or polyurethane. Polyurethane is a product of a reaction between a polyurethane prepolymer and a curing agent. The polyurethane prepolymer is a product formed by a reaction between a polyol and a diisocyanate. Often a catalyst is employed to promote the reaction between the curing agent and the polyurethane prepolymer. In the case of cast polyurethanes, the curing agent is typically either a diamine or glycol.

In another preferred embodiment, the castable reactive liquid material is a thermoset cast polyurethane. Thermoset cast polyurethanes are generally prepared using a diisocyanate, such as 2,4-toluene diisocyanate (TDI) or metbylenebis-(4-cyclohexyl isocyanate) (HMDI) and a polyol which is cured with a polyamine, such as methylenedianiline (MDA), or a trifunctional glycol, such as trimethylol propane, or tetrafinctional glycol, such as N,N,N',N'-tetrakis(2-hydroxpropyl)ethylenediamine.

However, the present invention is not limited to just these specific types of thermoset cast polyurethanes. Quite to the contrary, any suitable cast or non-cast thermoset polyurethane may be employed to form outer cover layers of the present invention.

Other suitable thermoset materials contemplated for the cover layers include, but are not limited to, thermoset urethane ionomers and thermoset urethane epoxies. Examples of suitable thermoset polyurethane ionomers are disclosed in U.S. Pat. No. 5,692,974, which is incorporated in its entirety by reference herein. Other examples of thermoset materials include polybutadiene, natural rubber, polyisoprene, styrene-butadiene, or styrene-propylene-diene rubber, which are particularly suitable when used in an intermediate layer of a golf ball.

When the cover includes more than one layer, e.g., an inner cover layer and an outer cover layer, various constructions and materials are suitable. For example, an inner cover layer may surround the windings with an outer cover layer disposed thereon. In another embodiment, an inner cover layer may surround an intermediate layer.

When using an inner and outer cover layer construction, the outer cover layer material in a first embodiment is preferably a thermoset material that includes at least one of a castable reactive liquid material and reaction products thereof, as described above, and preferably has a material hardness from about 30 Shore D to about 60 Shore D. In one embodiment, the outer cover layer is thin, preferably less than about 0.05 inches, and more preferably from about 0.02 inches to about 0.045 inches.

The inner cover layer may be formed from a wide variety of hard (about 60 ShoreD or greater, preferably from about 60 Shore D to about 74 Shore D), high flexural modulus resilient materials, which are compatible with the other materials used in the adjacent layers of the golf ball. The inner cover layer materials preferably is thermoplastic and has a flexural modulus of about 50,000 psi or greater. In one embodiment, the flexural modulus of the inner cover layer material is from about 50,000 psi to about 80,000 psi.

Suitable inner cover layer materials include the hard, high flexural modulus ionomer resins and blends thereof as disclosed in U.S. Pat. No. 5,885,172, which is incorporated in its entirety by reference herein. These ionomers are obtained by providing a cross metallic bond to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0–50 (preferably 0–25, most preferably 0–20), weight percent of the polymer, and Y is acrylic or methacrylic acid present in 5–35 (preferably at least about 16, more preferably at least about 16–35, most preferably at least about 16–20) weight percent of the polymer, wherein the acid moiety is neutralized 1–90% (preferably at least 40%, most preferably at least about 60%) to form an ionomer by a cation such as lithium*, sodium*, potassium, magnesium*, calcium, barium, lead, tin, zinc* or aluminum (*=preferred), or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers are made is well known in the art, as described in, e.g., U.S. Pat. No. 3,262,272, which is incorporated in its entirety by reference herein. Such ionomer resins are commercially available from DuPont under the tradename SURLYN® and from Exxon under the tradename Iotek®. Some particularly suitable SURLYNS® include SURLYN® 8140 (Na) and SURLYN® 8546 (Li) which have an methacrylic acid content of about 19 percent.

Examples of other suitable inner cover materials include thermoplastic or thermoset polyurethanes, polyetheresters, polyetheramides, or polyesters, dynamically vulcanized elastomers, functionalized styrene-butadiene elastomers, metallocene polymers, polyamides such as nylons, acrylonitrile butadiene-styrene copolymers (ABS), or blends thereof. Suitable thermoplastic polyetheresters include materials which are commercially available from DuPont under the tradename Hytrel®. Suitable thermoplastic polyetheramides include materials which are available from Elf-Atochem under the tradename Pebax®.

The wound layers can be formed of threads of various compositions such as threads formed from thermoset materials, poly(p-phenylene terephthalamide) such as KEVLAR, rubber, cis-1,4 polyisoprene rubbers or natural rubbers, or blends thereof as known by those of ordinary skill in the art, natural fibers, metal wire, graphite fibers, or the like. Glass fiber and, for example, S-GLASS from Corning Corporation can also be used. Additionally, mineral fibers such as silicates and vegetable fibers such as cellulosic and animal fibers can be used.

The wound layers can also be formed of thermoplastic thread, such as those formed of a polymeric material such as those disclosed in U.S. Pat. No. 6,149,535. Suitable polymers include polyether urea, such as LYCRA, polyester urea, polyester block copolymers such as HYTREL, isotactic-poly(propylene), polyethylene, polyamide, poly (oxymethylene), polyketone, poly(ethylene terephthalate) such as DACRON, poly(acrylonitrile) such as ORLON, trans, trans-diaminodicyclohexylmethane and dodecanedicarboxylic acid such as QUINA. LYCRA, HYTREL, DACRON, KEVLAR, ORLON, and QUINA are available from E. I. DuPont de Nemours & Co. U.S. patent application Ser. No. 09/266,847 filed on Mar. 12, 1999, entitled "Golf Ball With Spun Elastic Threads" is incorporated by reference herein in its entirety and discloses a method of forming suitable threads. When a thermoplastic thread is used, the ball may or may not include a cover. When the thread is fused to form a continuous outer surface of the ball, a cover is not necessary but preferable.

The thread used can also have various cross-sectional shapes, such as rectangular, square or circular, and be formed as a single ply, multiple ply or filament bundled thread.

The various dimensions of golf balls according to the present invention may vary. For example, the golf ball can have a diameter of about 1.68 inches to about 1.72 inches. However, the present invention is not limited to these values.

Core sizes can range from about ¾ inch to 1⅜ inches. However, core sizes are preferably from 1 inch to 1-3/16 inches. Similarly, the thickness of the envelope for fluid-filled centers can range widely, e.g. from about 0.02 inch to about 0.25 inch. The envelope thickness is preferred to be 0.075 to 0.15 inch. The thickness of the cover is also widely variable. Covers can be as thin as about 0.02 inch or as much as about 0.25 inch. Covers of about 0.03 inch to about 0.075 inch are preferred.

Natural rubber thread sizes are measured in the non-tensioned state and threads will generally have a width of about 0.02 inch to about 0.2 inch and a thickness of about 0.01 inch to about 0.1 inch. It is preferred that the thread have a width of about 0.05 inch to about 0.15 inch and a thickness of about 0.01 inch to about 0.05 inch. The amount of thread is, of course, a function of the size of the center, the size of the ball and the thickness of the cover. The thread occupies the volume between the outside of the center and the inside of the cover. The thickness of the wound layer can be between about 0.09 inches and about 0.3 inches.

Thermoplastic threads, in the non-tensioned state, preferably have an area less than about 0.003 square inches. In the tensioned state, they preferably have an area of about 0.0013 square inches.

While it is apparent that the illustrative embodiments of the invention herein disclosed fulfill the objectives stated above, it will be appreciated that numerous modifications and other embodiments may be devised by those skilled in the art. The embodiments above can also be modified so that some features of one embodiment are used with the features of another embodiment. For example, in other embodiments, the stress can be varied more than one hundred times in the wound layer. The balls can also be formed of more than one type of thread and different winding patterns such as great circle and criss-cross can be used at various times during winding and used alone or in combination with one anther. Therefore, it will be understood that the appended claims are intended to cover all such modifications and embodiments which come within the spirit and scope of the present invention.

We claim:

1. A golf ball comprising:

a center; and a wound layer surrounding the center to form a wound core, the wound layer being formed of at least one thread, and the wound layer including a plurality of radially extending sections, each section having a stress, and at least two radially extending sections have different stresses and the stress within each section being substantially constant;

wherein the thread further includes a cross-sectional area, and a first percentage variation in the stress within each section is less than a second percentage variation in the cross-sectional area of the thread within each section, a cover comprised of an inner layer and an outer layer.

2. The golf ball of claim 1, wherein stresses are different by at least 10%.

3. The golf ball of claim 1, wherein in a radially outward direction the stress increases from one radially extending section to another radially extending section.

4. The golf ball of claim 1, wherein in a radially outward direction the stress decreases from one radially extending section to another radially extending section.

5. The golf ball of claim 1, further including at least two radially extending sections and each section has a thickness equal to at least 25% of a total wound layer thickness, wherein the stress of each radially extending section is different from the stress in the adjacent radially extending section.

6. The golf ball of claim 5, further including at least three different stresses.

7. The golf ball of claim 1, wherein the thickness of each radially extending section is from about 0.007 inches to about 0.008 inches.

8. A golf ball comprising:

a center;

a wound layer surrounding the center to form a wound core, the wound layer being formed of at least one thread, and the wound layer including a plurality of radially extending sections, each section having a stress, and at least two radially extending sections have different stresses and the stress within each section being substantially constant; and a cover comprised of an inner layer and an outer layer;

wherein the inner layer is comprised of a thermoset material selected from the group of thermoset vinyl resins, thermoset polyolefins, thermoset polyurethanes, thermoset polyureas, thermoset polyamides and thermoset acrylic resins.

9. The golf ball of claim 8, wherein the outer layer is a thermoplastic material having a flexural modulus of at least 50,000 psi.

10. A golf ball comprising:

a center;

a wound layer surrounding the center to form a wound core, the wound layer being formed of at least one thread, and the wound layer including a plurality of radially extending sections, each section having a stress, and at least two radially extending sections have different stresses and the stress within each section being substantially constant; and a cover comprised of an inner layer and an outer layer;

wherein the inner layer is a thermoplastic material with a flexural modulus of greater than 50,000 psi.

11. The golf ball of claim 10, wherein the outer layer is comprised of a thermoset material selected from the group of polyurethanes and polyureas.

12. A golf ball comprising:

a center;

a wound layer surrounding the center to form a wound core, the wound layer being formed of at least one thread, and the wound layer including a plurality of radially extending sections, each section having a stress, and at least two radially extending sections have different stresses and the stress within each section being substantially constant; and a cover comprised of an inner layer and an outer layer;

wherein the inner layer is a thermoplastic non-ionomeric material selected from the group of vinyl resins, polyolefins, polyamides, acrylic resins, thermoplastic polyurethanes, olefinic thermoplastic rubbers, polyphenylene oxide resins, and thermoplastic polyesters.

* * * * *